United States Patent [19]

Parker et al.

[11] Patent Number: 5,021,838

[45] Date of Patent: Jun. 4, 1991

[54] PREFERRED TONER/CARRIER PROPERTIES

[75] Inventors: Delmer G. Parker, Rochester; William M. Allen, Jr., Webster; Howard M. Stark, Williamson, all of N.Y.

[73] Assignee: Xerox Corporation, Stamford, Conn.

[21] Appl. No.: 389,465

[22] Filed: Aug. 3, 1989

[51] Int. Cl.[5] ..... G03G 15/01

[52] U.S. Cl. ..... 355/328; 355/245; 430/45

[58] Field of Search ..... 355/326, 328, 296, 245, 355/301; 430/42, 45, 120, 122, 125; 118/653

[56] References Cited

U.S. PATENT DOCUMENTS

| | | | |
|---|---|---|---|
| 4,078,929 | 3/1978 | Gundlach | 96/1.2 |
| 4,264,185 | 4/1981 | Ohta | 355/326 |
| 4,430,402 | 2/1984 | Tsushima | 430/45 |
| 4,525,447 | 6/1985 | Tanaka et al. | 430/120 X |
| 4,539,281 | 9/1985 | Tanaka et al. | 430/45 |
| 4,572,651 | 2/1986 | Komatsu et al. | 430/45 X |
| 4,594,302 | 6/1986 | Kubo | 430/45 X |
| 4,761,668 | 8/1988 | Parker et al. | 355/3 DD |
| 4,761,672 | 8/1988 | Parker et al. | 355/14 D |
| 4,771,314 | 9/1988 | Parker et al. | 355/4 |
| 4,811,046 | 3/1989 | May | 355/4 |
| 4,833,504 | 5/1989 | Parker et al. | 355/326 |

FOREIGN PATENT DOCUMENTS

| | | | |
|---|---|---|---|
| 0214049 | 12/1984 | Japan | 355/326 |

*Primary Examiner*—Arthur T. Grimley
*Assistant Examiner*—William J. Royer

[57] ABSTRACT

Tri-Level Highlight color imaging apparatus utilizing two-component developer materials in each of a plurality of developer housings. The triboelectric properties of the toners and carriers forming the two-component developers are such that inter-mixing of the components of each developer with the components in another developer housing is minimized.

5 Claims, 2 Drawing Sheets

PREFERRED TONER/CARRIER PROPERTIES

BACKGROUND OF THE INVENTION

This invention relates generally to the rendering of latent electrostatic images visible using multiple colors of dry toner or developer and, more particularly, to two-component developers in a plurality of housings which have triboelectric properties which preclude cross-mixing of the toners into the developer housings.

The invention can be utilized in the art of xerography or in the printing arts. In the practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e. CAD) stays at the full photoreceptor potential ($V_{ddp}$ or $V_{cad}$, see FIGS. 1*a* and 1*b*). The other image is exposed to discharge the photoreceptor to its residual potential, i.e. $V_c$ or $V_{dad}$ (typically 100 v) which corresponds to discharged area images that are subsequently developed by discharged-area development (DAD). The background areas exposed such as to reduce the photoreceptor potential to halfway between the $V_{cad}$ and $V_{dad}$ potentials, 500 v) and is referred to as $V_w$ or $V_{white}$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

Because the composite image developed on the charge retentive surface consists of both positive and negative toner a pre-transfer corona charging step is necessary to bring all the toner to a common polarity so it can be transferred using corona charge of the opposite polarity.

Various techniques have heretofore been employed to develop electrostatic images as illustrated by the following disclosures which may be relevant to certain aspects of the present invention.

U.S. Pat. No. 4,761,668 granted to Parker et al and assigned to the same assignee as the instant application which relates to tri-level printing discloses apparatus for minimizing the contamination of one dry toner or developer by another dry toner or developer used for rendering visible latent electrostatic images formed on a charge retentive surface such as a photoconductive imaging member. The apparatus causes the otherwise contaminating dry toner or developer to be attracted to the charge retentive surface in its inter-document and outboard areas. The dry toner or developer so attracted is subsequently removed from the imaging member at the cleaning station.

U.S. Pat. No. 4,761,672 granted to Parker et al and assigned to the same assignee as the instant application which relates to tri-level printing discloses apparatus wherein undesirable transient development conditions that occur during start-up and shut-down in a tri-level xerographic system when the developer biases are either actuated or deactuated are obviated by using a control strategy that relies on the exposure system to generate a spatial voltage ramp on the photoreceptor during machine start-up and shut-down. Furthermore, the development systems' bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and developing characteristics, the charging of the photoreceptor can be varied in accordance with the change of developer bias voltage.

U.S. Pat. No. 4,811,046 granted to Jerome E. May and assigned to the same assignee as the instant application which relates to tri-level printing discloses apparatus wherein undesirable transient development conditions that occur during start-up and shut-down in a tri-level xerographic system when the developer biases are either actuated or deactuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in the contact-prevention direction to permit use of the tri-level system to be utilized as a single color system or for the purpose of agitating developer in only one of the housings at a time to insure internal triboelectric equilibrium of the developer in that housing.

U.S. Pat. No. 4,771,314 granted to Parker et al and assigned to the same assignee as the instant application which relates to tri-level printing discloses printing apparatus for forming toner images in black and at least one highlighting color in a single pass of a charge retentive imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

U.S. Pat. No. 4,833,504 granted to Parker and assigned to the same assignee as the instant application which relates to tri-level printing discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complementary half of a tri-level latent image while at the same time allowing the already developed first half to pass through the second housing with minimum image disturbance.

U.S. Pat. No. 4,901,114 granted to Parker et al and assigned to the same assignee as the instant application which relates to tri-level printing discloses an electronic printer employing tri-level xerography to superimpose two images with perfect registration during the single pass of a charge retentive member past the processing stations of the printer. One part of the composite image is formed using Magnetic Ink Character Recognition (MICR) toner, while the other part of the image is printed with less expensive black, or color toner. For example, the magnetically readable information on a check is printed with MICR toner and the rest of the check in color or in black toner that is not magnetically readable.

The problem of fringe field development in a tri-level highlight color, single pass imaging system is addressed in U.S. Pat. No. 4,847,655 granted to Parker et al assigned to the same assignee as the instant invention.

In this application there is disclosed a magnetic brush developer apparatus comprising a plurality of developer housings each including a plurality of magnetic brush rolls associated therewith. Conductive magnetic brush (CMB) developer is provided in each of the developer housings. The CMB developer is used to develop electronically formed images. The developer conductivity, as measured in a powder electrical conductivity cell, is in the range of $10^{-9}$ to $10^{-13}$ (ohm-cm)$^{-1}$. The toner concentration of the developer is in the order of 2.0 to 3.0% by weight and the toner charge level is less than 20 microcoulombs/gram and the developer rolls are spaced from the charge retentive surface a distance in the order of 0.40 to 0.120 inch.

U.S. Pat. No. 4,868,611 granted to Germain and assigned to the same assignee as the instant invention discloses a highlight color imaging method and apparatus including structure for forming a single polarity charge pattern having at least three different voltage levels on a charge retentive surface wherein two of the voltage levels correspond to two image areas and the third voltage level corresponds to a background area. Interaction between developer materials contained in a developer housing and an already developed image in one of the two image areas is minimized by the use of a scorotron to neutralize the charge on the already developed image.

U.S. Pat. No. 4,430,402 granted to Shuichi Tsushima on Feb. 7, 1984 discloses a two-component type dry developer for use in dichromatic electrophotography comprising two kinds of developers, wherein the developers comprise a toner and a carrier and are adapted to develop both positively and negatively electrified electrostatic images successively with toners different in polarity and color from each other and further wherein one carrier has a triboelectrification property of being electrified positively by friction with either of the two toners while the other carrier has a triboelectrification property of being electrified negatively by friction with either of the two toners.

U.S. Pat. No. 4,539,281 issued on Sept. 3, 1985 to Tanaka et al discloses the method of forming a dichromatic image using a first developer comprising a magnetic toner which is substantially not triboelectrically chargeable with the magnetic carrier of a second developer.

U.S. Pat. No. 4,868,608 granted to Allen, Jr. et al and assigned to the same assignee as the instant application discloses a tri-level highlight color imaging apparatus and cleaner apparatus therefor. Improved cleaning of a charge retentive surface is accomplished through matching the triboelectric properties of the positive and negative toners and their associated carriers as well as the carrier used in the magnetic brush cleaner apparatus. The carrier in the cleaner upon interaction with the two toners causes them to charge to the same polarity. The carrier used in the cleaner is identical to the one used in the positive developer. The carrier of the negative developer was chosen so that the toner mixed therewith charged negatively in the developer housing.

Thus, the combination of toners and carriers is such that one of the toners charge positively against both carriers and the other of the toners charges negatively against one of the carriers and positively against the other. Due to the application of a positive pre-transfer corona both the toners are positive when they reach the cleaner housing and because the carrier employed causes both of the toners to charge positively, toner polarity reversal is precluded.

In both the '281 patent and the '608 patent, contamination of the toner in the second developer housing and disturbance of the first image are prevented or minimized by the use of a toner in the first developer housing which has minimal triboelectric interaction with the carrier of the second developer housing.

While the images developed by the second developer housing do not ordinarily move past the first developer housing, we have observed that in certain instances toner forming the second image or toner from an intra-document developability control patch does move through the first housing. In the case of a paper misfeed, the images formed in the second developer housing will move through the first developer housing and in the case of the inter-document developability control patch when the cleaning system is overly stressed some of the toner forming the patch finds its way into the first developer housing. In the case of the control patch the problem of image degradation is not a problem but contamination of the first developer mixture is. The problem is the worst when the toner in the first housing is the colored toner and the toner in the second housing is the black toner.

BRIEF SUMMARY OF THE INVENTION

In accordance with the present invention there is provided a tri-level highlight color imaging apparatus utilizing two-component (i.e. toner and carrier) developer materials in at least two developer housings. The two complimentary developer packages in the developer housings are such that the positive and negative toners have negligible tribo interaction with their complimentary (other) developer's carrier thereby insuring minimal interaction between the developed images and and the developer in the complimentary developer housings.

DETAILED DESCRIPTION OF THE PREFERRED EMBODIMENT OF THE INVENTION

Figure 1A:
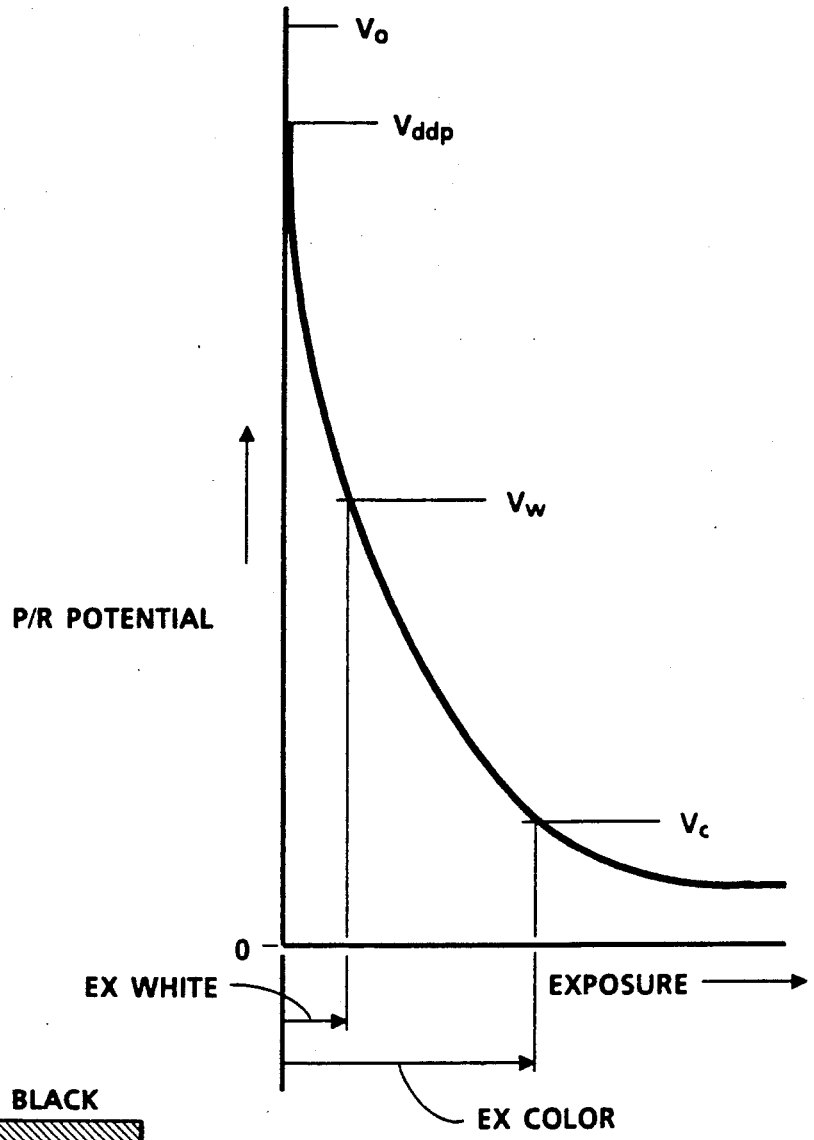
FIG. 1*a* is a plot of photoreceptor potential versus exposure illustrating a tri-level electrostatic latent image.
Figure 1B:
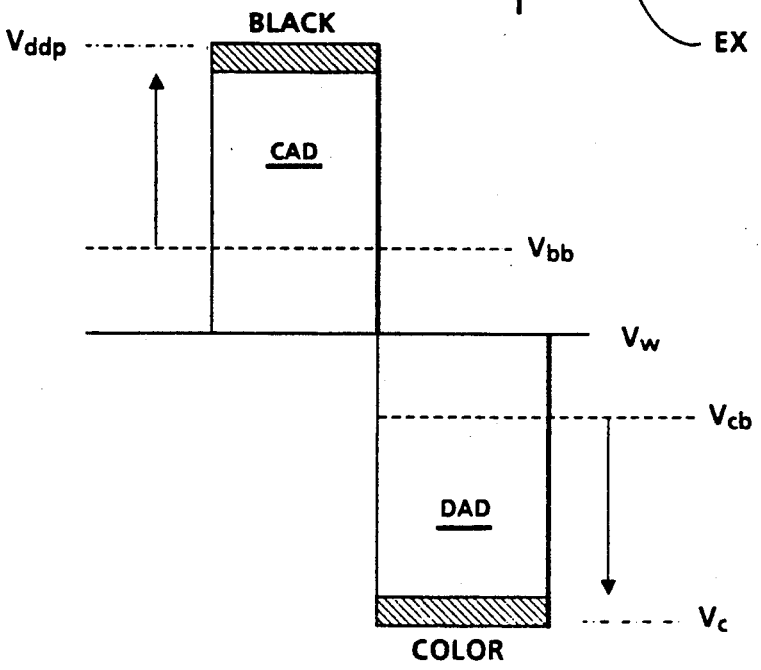
FIG. 1*b* is a plot of photoreceptor potential illustrating single-pass, highlight color latent image characteristics.

For a better understanding of the concept of tri-level imaging, a description thereof will now be made with reference to FIGS. 1*a* and 1*b*. FIG. 1*a* illustrates the tri-level electrostatic latent image in more detail. Here $V_o$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved by passing the photoreceptor through two developer housings in tandem which housings are electrically biased to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electric field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electric field existing between the photoreceptor and the development rolls in the first housing at bias voltage $V_{cb}$ (V color bias).

Figure 2:
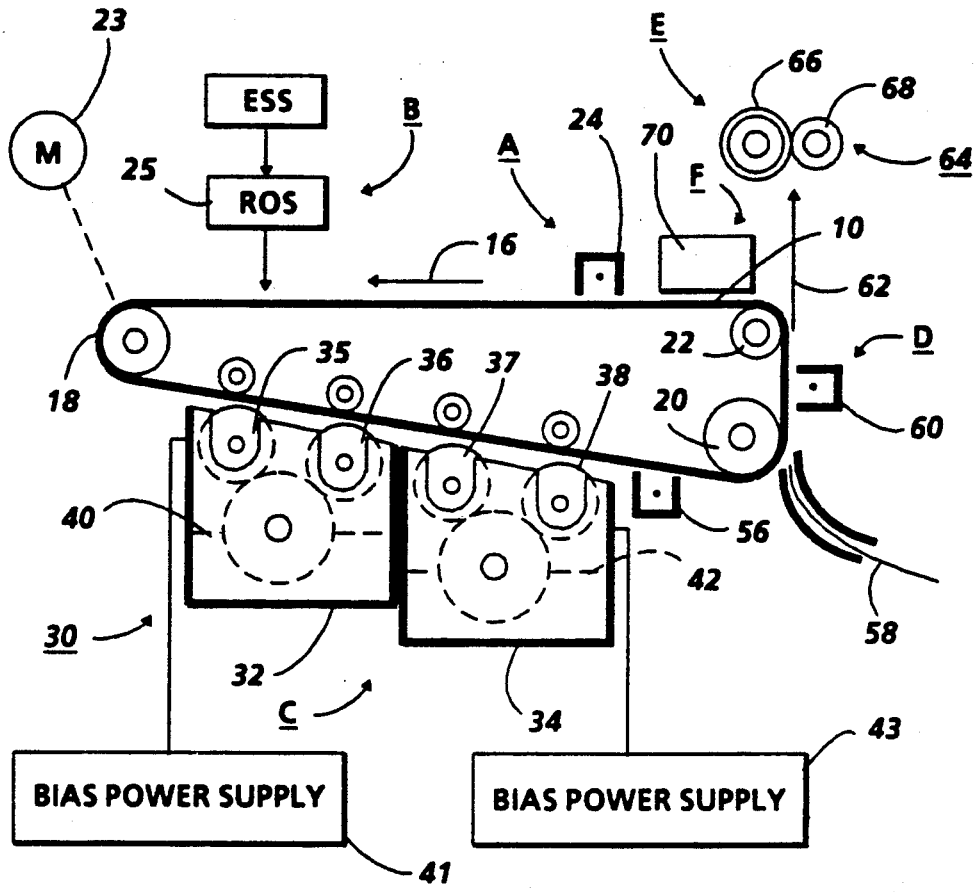
FIG. 2 is schematic illustration of a printing apparatus incorporating the inventive features of our invention.

As shown in FIG. 2, a printing machine incorporating our invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_o$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1*a*.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first) contains black developer 40 having triboelectric properties such that the black toner is driven to the most highly charged areas at the potential $V_{ddp}$ of the latent image by the electrostatic field (development field) between the photoreceptor and the development rolls biased at $V_{bb}$ as shown in FIG. 1*b*. Conversely, the triboelectric charge on red developer 42 in the second housing is chosen so that the red toner is urged towards the parts of the latent image at the residual potential $V_c$ by the electrostatic field (development field) existing between the photoreceptor and the development rolls in the second housing at bias voltages $V_{cb}$.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 3:
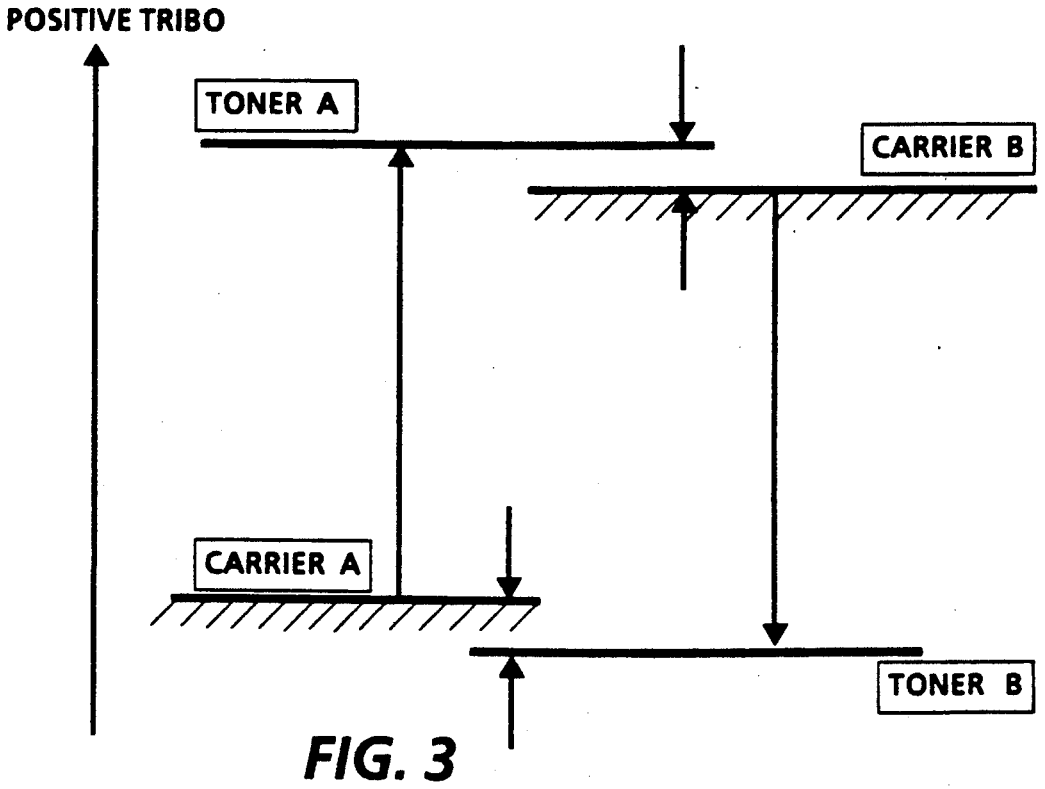
FIG. 3 discloses tribo relationships of various combinations of toners and carriers utilized in carrying out the present invention.

The triboelectric properties of the toners and carriers utilized in the developer housings 32 and 34 are such that the positive and negative toners used have a high degree of interaction with their respective carriers thereby charging to polarities opposite to their respective carriers. On the other hand, the toners, as depicted in FIG. 3, exhibit relatively little interaction with their complimentary carriers (i.e. the carrier of the other developer).

What is claimed is:

1. Printing apparatus comprising:

means for forming visible images on a charge retentive surface;

said means for forming visible images comprising at least first and second developer structures;

means for moving said charge retentive surface past said first and second developer structures in that order;

first developer material contained in said first developer structure, said first developer material comprising first toner and first carrier particles;

second developer material contained in said second developer structure said second developer material comprising second toner and second carrier particles;

means for removing residual toner from said charge retentive surface;

said first and second carriers having triboelectric properties relative to said first and second toners such that said first and second toners charge to opposite polarities against their respective carriers and such that the degree of charging of said first toner against said second carrier particles and said second toner against said first carrier particles is relatively small and therefore insufficient to change their polarities thereby precluding contamination of said second developer material with said first toner and contamination of said first developer material with said second toner.

2. Apparatus according to claim 1 including corona discharge means for changing the polarity of one of said toners prior to the residual toner being removed by said residual toner removing means.

3. Apparatus according to claim 2 wherein said corona discharge means comprises a positive corotron.

4. Apparatus according to claim 3 wherein said first and second toners are different colors.

5. A method of printing powder images including the steps of:

forming a tri-level image on a charge retentive surface;

developing a portion of said tri-level image with a first toner and carrier particle mixture having triboelectric properties such that the toner of the first mixture charges to a first polarity when the developer is agitated;

developing a second portion of said tri-level image with a second toner and carrier particle mixture having triboelectric properties such that the second mixture charges to a second polarity which is opposite to said first polarity;

said toner of said first toner and carrier mixture having triboelectric properties relative to the carrier of said second mixture and said toner of said second toner and carrier mixture having triboelectric properties relative to the carrier of said first toner and carrier mixture such that the degree of charging of said first toner against said carrier particles of said second mixture and the degree of charging of said second toner against said first carrier is relatively small and therefore insufficient to change their polarities thereby minimizing contamination of said second mixture with toner from said first mixture and contamination of said first mixture with toner from said second mixture.

transferring said tri-level image to a copy substrate; and removing residual toner from said charge retentive surface.

* * * * *